US009527559B2

(12) United States Patent
Ford

(10) Patent No.: US 9,527,559 B2
(45) Date of Patent: Dec. 27, 2016

(54) BOAT BRUSH TOOL

(71) Applicant: Thomas Michael Ford, Huntersville, NC (US)

(72) Inventor: Thomas Michael Ford, Huntersville, NC (US)

( * ) Notice: Subject to any disclaimer, the term of this patent is extended or adjusted under 35 U.S.C. 154(b) by 0 days.

(21) Appl. No.: 13/762,016

(22) Filed: Feb. 7, 2013

(65) Prior Publication Data

US 2014/0216321 A1 Aug. 7, 2014

(51) Int. Cl.
*B63B 59/00* (2006.01)
*B63B 59/06* (2006.01)

(52) U.S. Cl.
CPC ..... *B63B 59/06* (2013.01)

(58) Field of Classification Search
CPC ..... B63B 59/08; B63B 59/06
USPC ..... 114/222
See application file for complete search history.

(56) References Cited

U.S. PATENT DOCUMENTS

| | | | | |
|---|---|---|---|---|
| 693,242 | A | 2/1902 | Culpepper | |
| 1,742,929 | A * | 1/1930 | Ovtshenikoff | 15/160 |
| 4,011,827 | A | 3/1977 | Fond | |
| 4,102,290 | A | 7/1978 | Weiss | |
| 4,202,068 | A | 5/1980 | Lester et al. | |
| 4,991,533 | A * | 2/1991 | Sterling | 114/222 |
| 5,105,752 | A * | 4/1992 | Pompei et al. | 114/222 |
| 5,685,251 | A | 11/1997 | Halko | |
| 6,263,821 | B1 | 7/2001 | Hodder | |
| 6,840,187 | B2 | 1/2005 | Tible | |
| 7,500,441 | B2 | 3/2009 | Van-Zwol | |
| 7,536,966 | B2 * | 5/2009 | Stryjewski | B63B 7/04 114/61.1 |
| 8,544,916 | B2 * | 10/2013 | Acquah | 294/175 |
| 2011/0162570 | A1 * | 7/2011 | Moser | 114/222 |

* cited by examiner

*Primary Examiner* — Stephen Avila
(74) *Attorney, Agent, or Firm* — Ronald L. Hofer

(57) ABSTRACT

A boat brush tool for cleaning a boat pontoon, the boat brush tool having a generally J-shaped tubular support member with an upper section for manipulating the tool and a lower section carrying a plurality of brush bristles and having a curved shape corresponding to the outer surface of the pontoon.

2 Claims, 1 Drawing Sheet

FIG 1
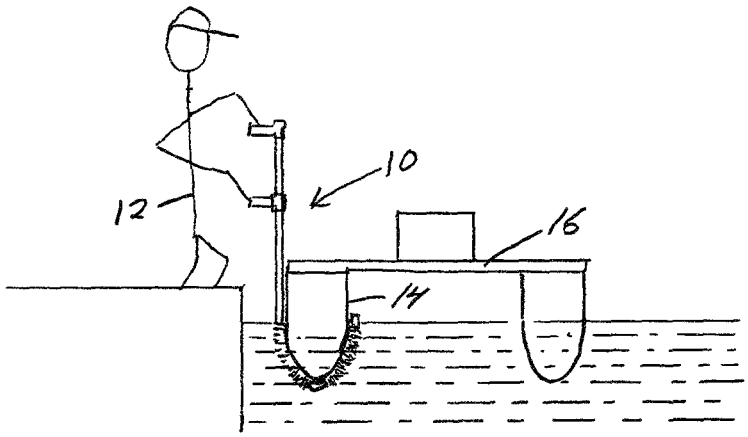
FIG 2
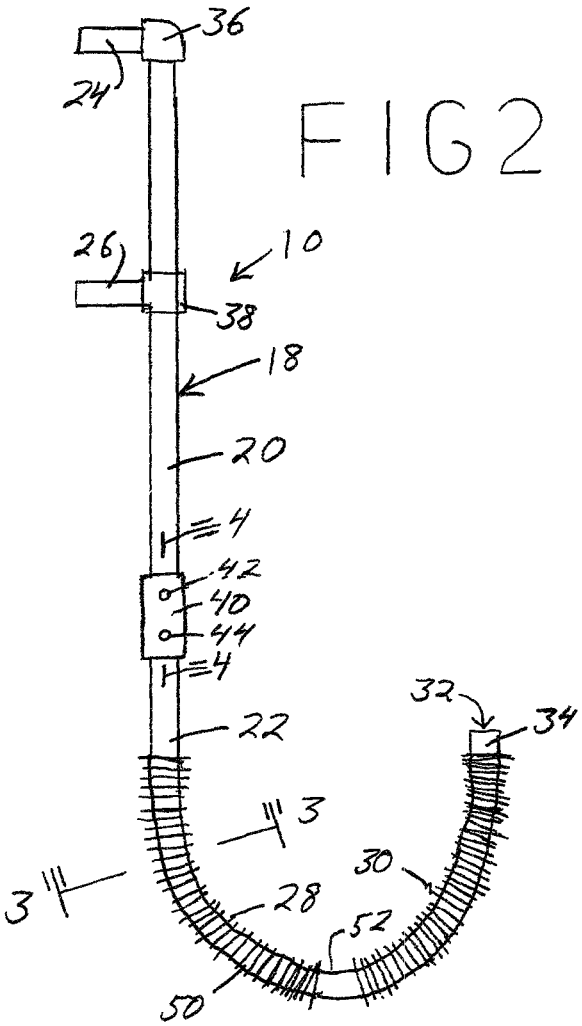
FIG 4
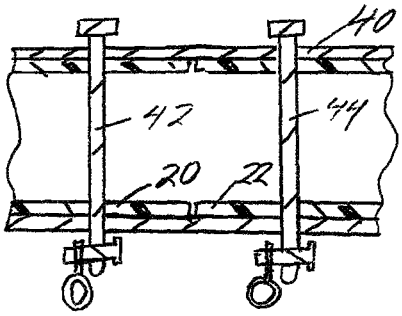
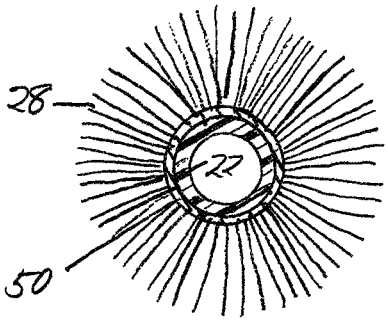
FIG 3

BOAT BRUSH TOOL

FIELD OF THE INVENTION

This invention relates to devices for cleaning boat hulls in the water. More specifically, this invention relates to a boat hull cleaning device which is particularly well suited for cleaning pontoons.

BACKGROUND OF THE INVENTION

There are many pontoon boats at the docks and in the water in the lakes of the United States and other countries. Unfortunately, each pontoon that is left in the water accumulates unwanted material at the water/pontoon interface. The accumulations may be dirt, algae, slime, seaweed, shellfish, or other unwanted materials. In any event, accumulations of material on pontoons have the well-known effect of reducing the pontoon's efficiency to move through the water. Thus, more power, and hence, more fuel, is required to maintain a given speed. The well-known solution, of course, is to remove the accumulations frequently to maintain a clean, efficient pontoon.

In many instances it is necessary to frequently clean each pontoon to maintain an efficient boat. It is not uncommon to clean each pontoon on a weekly basis as a routine matter. Such routine maintenance amounts to a lot of work and any improvement which reduces the effort involved in cleaning pontoon hulls would be greatly appreciated by those cleaning pontoon hulls. Even a small improvement in efficiency of each cleaning effort would yield large total dividends because of the frequency of cleaning events required by routine maintenance.

There have been efforts to provide machines for cleaning boat hulls but machines can be expensive and require power for their use. There also have been efforts to provide hand tools which require only human power and which can be manipulated for cleaning boat hulls. For example, U.S. Pat. No. 693,242 Feb. 11, 1902 to Culpepper for APPARATUS FOR CLEANING BOTTOMS OF SHIPS, discloses an apparatus using brushes which are forcibly thrust against a ships bottom by the reactionary effect of a stream of water issuing from a nozzle which projects at right angles to the plane of the brush arms. U.S. Pat. No. 6,263,821 Jul. 24, 2001 to Hodder for CLEANING MEANS, discloses a boat hull cleaner having a telescoping handle with a buoyancy control means and a scrubbing brush. U.S. Pat. No. 4,102,290 Jul. 25, 1978, to Weiss for UNDERWATER BOTTOM CLEANING SYSTEM AND APPARATUS, discloses a system and apparatus for cleaning submerged portions of hulls with a cyclically movable brush having a motor driven by air or other gas. The Weiss apparatus has means having variable buoyancy to lift and lower the cleaning means of brush assembly into and out of varying cleaning relation with respect to the hull. U.S. Pat. No. 4,202,068 to Lester at al. for PORTABLE SCRUBBING TOOL discloses a pneumatic powered portable scrubbing tool having a scrubbing brush member that is rotated by an air powered motor.

While there has been interest in developing machines and tools for cleaning boat hulls, there remains a need for improvements with respect to tools for cleaning pontoons. Some tools would be too expensive for an average small boat owner. Other tools would be too difficult for one person to effectively manipulate. Thus, it would be desirable to have an economical, practical, easy to manipulate tool for cleaning pontoons of pontoon boats and the like. Accordingly the present invention provides a tool especially designed and particularly well adapted for cleaning the pontoons of a pontoon boat.

Further understanding of the present invention will be had from the following specification and claims taken in conjunction with the accompanying drawings.

BRIEF DESCRIPTION OF THE DRAWINGS

FIG. 1 shows a diagrammatic elevation view showing a preferred embodiment of a boat brush of the present invention in use cleaning the pontoon of a pontoon boat;

FIG. 2 is an elevation view of the preferred embodiment shown in FIG. 1;

FIG. 3 is a sectional view taken along line 3-3 in FIG. 2; and

FIG. 4 is a sectional view 3 taken along line 4-4 in FIG. 2.

SUMMARY OF THE INVENTION

A boat brush tool for cleaning a boat pontoon, said tool having a generally J-shaped tubular support member having an upper section for manipulating said tool and a lower section for cleaning a pontoon or the like, said lower section carrying a plurality of brush bristles and a having a shape curved to correspond to the outer surface of said pontoon.

DESCRIPTION OF THE INVENTION

Now referring to FIG. 1, a preferred embodiment of a boat brush tool of the present invention is shown and indicated generally by the 10. FIG. 1 shows boat brush tool 10, somewhat diagrammatically, in use by a person 12 cleaning pontoon 14 of pontoon boat 16. The preferred embodiment of a boat brush tool of the present invention is described herein for use to clean pontoons of pontoon boats which is a preferred use of this invention. Of course, it will be appreciated by those skilled in the art that a boat brush tool of the present invention may be broadly useful for other purposes so long as such use is not inconsistent with the purpose of this invention.

As best shown in FIG. 2, boat brush tool 10 generally comprises a J-shaped support member 18 which has upper section 20 and lower section 22. Both upper section 20 and lower section 22 can be comprised of PVC tubing or similar material. Upper section 20 of J-shaped support member 18 extends upwardly long enough for a person to manipulate tool 10 to clean a boat pontoon. To facilitate manipulation of boat brush tool 10, upper section 18 has an upper handle 24 and a lower handle 26. Lower section 22 of support member 18 carries bristle sections 28 and 30 which are provided for proper abrasion of pontoon 14 or the like during the use of tool 10.

It is contemplated that J-shaped support member 18 will have a lower section 22 that is shaped for use as a cleaning tool for pontoons or other suitable shapes of hulls in water. Preferably support member 18 has a lower section 22 which is curved to correspond to the shape of the pontoon to be cleaned.

Also, preferably support member 18 has a hollow interior 32. Hollow interior 32 gives lower section 22 buoyancy in water and hence applies force in an upward direction against pontoon 14 when tool 10 is in use. This upward force assists in cleaning pontoon 14. It is also preferred that J-shaped support member 18 will be comprised of PVC pipe or other relatively lightweight material which can be readily formed to conform to a desired shape to correspond to a particular pontoon.

While J-shaped support member 18 may be of various constructions, in the preferred embodiment shown in the figures J-shaped support member 18 includes a cap 34 for sealing the lower section 22 of member 18 and an upper elbow 36 and lower T-shaped joint 38 for respectively attaching and securing handles 24 and 26 to upper section 20 of support member 18.

It is preferred that support member 18 be portable for easy transportation in a boater's automotive vehicle. Since support member 18 is somewhat long, t is desirable that support member 18 be able to be broken down into two or more pieces. For this purpose, support member 18 is provided in two sections as shown in FIGS. 2 and 3, upper section 20 and lower section 22 which are held together by tubular sleeve 40 with pins 42 and 44 for securing sleeve 40 to upper section 20 and lower section 22 respectively.

Lower section 22 of support member 18 carries bristle sections 46 and 48 which extend from a metal sleeve 50 spirally wrapped around lower section 22 of support member 18. A gap 52 is provided between adjacent ends of bristle sections 46 and 48 to provide room for a keel of a pontoon. Optionally, a shoe or roller bearing can be attached to lower section 22 in gap 52 to be in contact with the keel of the keel to facilitate movement of lower section 22 along the keel during use of brush tool 10. Of course, various means for attaching bristles to lower section 22 may be employed within the broad scope of the present invention so long as such means is consistent with the purpose of brush tool 10.

In use, boat brush 10 can be brought to the water in two pieces and then assembled on site near the pontoon boat to be cleaned. Once assembled, lower section 22 of boat brush 10 is placed against the pontoon to be cleaned so that the curve of lower section 22 mates with the pontoon itself. Then, boat brush 10 is manipulated by the user whose hands can grasp upper section handles 24 and 26.

While the present invention has been disclosed in terms of a preferred embodiment, brush tool 10, it will be appreciated by those skilled in the art that this invention is subject to modification and variation within the broad scope of the invention and such modifications and variations are to be included within the scope of this invention which is limited only by the following claims.

What is claimed is:

1. A pontoon boat brush tool in combination with a pontoon of a pontoon boat in a body of water, said tool for cleaning said boat pontoon while said boat pontoon is in said body of water, said pontoon having a convex curved outer surface in said water and a keel, said tool having a generally J-shaped tubular support member having an upper section extending well above said water for manipulating said tool from a standing position well above said water and a lower section, said upper section having an upper handle and a lower handle attached thereto and said lower section carrying a plurality of brush bristles and having a curved shape corresponding to, and in contact with, said convex curved outer surface of said pontoon, said brush bristles having a proximate section and a distal section with a gap therebetween, said gap being at least as large as the width of said keel, said upper section and said lower section consist of two separate pieces held together by a sleeve and two pins.

2. A pontoon boat brush tool in combination with a pontoon of a pontoon boat in a body of water, said tool for cleaning said boat pontoon while said boat pontoon is in said body of water, said pontoon having a convex curved outer surface in said water, said tool having a generally J-shaped tubular support member having an upper section extending well above said water for manipulating said tool from a standing position well above said water and a lower section, said lower section carrying a plurality of brush bristles and having a curved shape corresponding to, and in contact with, said convex curved outer surface of said pontoon, said lower section comprising a tubular member with a spiral sleeve wrapped thereabout, said plurality of brush bristles extending radially outwardly from said spiral sleeve.

* * * * *